US012392336B2

(12) United States Patent
Nestor et al.

(10) Patent No.: US 12,392,336 B2
(45) Date of Patent: Aug. 19, 2025

(54) BELLOWS PUMP FOR LIQUID METALS

(71) Applicant: Westinghouse Electric Company LLC, Cranberry Township, PA (US)

(72) Inventors: Christopher Nestor, Murrysville, PA (US); Michael A. Lapresti, Greensburg, PA (US); John Lojek, III, Latrobe, PA (US)

(73) Assignee: Westinghouse Electric Company LLC, Norwalk, CT (US)

( * ) Notice: Subject to any disclaimer, the term of this patent is extended or adjusted under 35 U.S.C. 154(b) by 0 days.

(21) Appl. No.: 18/184,023

(22) Filed: Mar. 15, 2023

(65) Prior Publication Data

US 2024/0309862 A1 Sep. 19, 2024

(51) Int. Cl.
*F04B 43/08* (2006.01)
*F04B 15/00* (2006.01)

(52) U.S. Cl.
CPC ..... *F04B 43/084* (2013.01); *F04B 15/00* (2013.01)

(58) Field of Classification Search
CPC ..... F04B 15/00–04; F04B 45/02–0336; F04B 43/084–088; F04B 43/0072
USPC ..... 417/472–473
See application file for complete search history.

(56) References Cited

U.S. PATENT DOCUMENTS 3,529,908 A * 9/1970 Smith ..... F04B 43/08 92/84
3,598,505 A * 8/1971 Greene ..... F04B 49/02 417/220
3,703,342 A * 11/1972 O'Connor ..... F04B 43/08 417/326
4,047,851 A * 9/1977 Bender ..... F04B 43/08 222/336
4,365,942 A * 12/1982 Schmidt ..... H01F 6/005 505/910

(Continued)

FOREIGN PATENT DOCUMENTS

CN 1760550 A 4/2006
CN 203130400 U 8/2013

(Continued)

OTHER PUBLICATIONS

International Search Report and Written Opinion for corresponding International Application No. PCT/US2024/019895 mailed Jul. 18, 2024.

(Continued)

*Primary Examiner* — Alexander B Comley
(74) *Attorney, Agent, or Firm* — K&L Gates LLP

(57) ABSTRACT

According to various aspects, the present disclosure provides pumps for pumping a liquid metal, systems for filling a container with a liquid metal, and methods for filling a container with a liquid metal. According to at least one aspect, a pump can include an actuator including a drive rod, a first plate, a second plate, guide rods extending between the first plate and the second plate, a traveling stage, and a bellows. The traveling stage can be operatively coupled to the drive rod and can be slidable along the guide rods intermediate the first plate and the second plate. The bellows can extend between the second plate and the traveling stage to define a bellows chamber. The actuator can be configured to slide the traveling stage to expand and contract the bellows to pump the liquid.

14 Claims, 6 Drawing Sheets

(56) References Cited

U.S. PATENT DOCUMENTS 4,421,464 A * 12/1983 Schmidt ..... H02K 55/00 417/418
4,483,665 A * 11/1984 Hauser ..... F04B 43/107 417/472
4,618,425 A * 10/1986 Yates ..... F04B 43/1136 210/167.01
4,858,478 A * 8/1989 Kush ..... G01N 1/24 417/63
4,902,206 A * 2/1990 Nakazawa ..... F04B 43/1136 92/37
5,141,412 A * 8/1992 Meinz ..... F04B 43/086 92/37
5,195,878 A * 3/1993 Sahiavo ..... F01L 25/063 417/393
5,308,230 A * 5/1994 Moore ..... F04B 43/1136 417/394
5,573,385 A * 11/1996 Chevallier ..... F04B 15/04 417/393
5,820,772 A * 10/1998 Freitag ..... F04B 43/06 222/591
6,024,345 A * 2/2000 Nishio ..... F16F 1/027 417/559
6,059,546 A * 5/2000 Brenan ..... F03G 7/065 417/393
6,189,433 B1 * 2/2001 Harada ..... F04B 43/1136 92/34
6,358,468 B1 * 3/2002 VanderJagt ..... B22D 39/00 266/239
8,636,484 B2 * 1/2014 Simmons ..... F04B 9/135 92/34
2003/0226615 A1 * 12/2003 Allen ..... F04B 43/084 141/6
2008/0304977 A1 * 12/2008 Gaubert ..... F04F 5/24 417/86
2014/0072465 A1 * 3/2014 Adachi ..... F04B 45/022 417/472
2016/0327032 A1 * 11/2016 Jaeger ..... F04B 53/08
2019/0383280 A1 * 12/2019 Simmons ..... F04B 45/02
2020/0025191 A1 * 1/2020 van Boeyen ..... F04B 43/1136
2020/0132058 A1 * 4/2020 Mollatt ..... F04B 45/033
2021/0310477 A1 * 10/2021 Heintzelman ..... F04B 13/00

FOREIGN PATENT DOCUMENTS

CN 104295473 A * 1/2015
GB 1477191 A 6/1977
WO 99/31388 A1 6/1999
WO 2022/223404 A1 10/2002

OTHER PUBLICATIONS

"Austenitic stainless steel—Wikipedia", May 5, 2024 (May 5, 2024), XP093161809, Retrieved from the Internet: URL: https://en.wikipedia.org/wiki/Austenitic_stainless_steel.
Search Report for corresponding Taiwan Application No. 113109375, mailed May 14, 2025.

* cited by examiner

BELLOWS PUMP FOR LIQUID METALS

GOVERNMENT CONTRACT

This invention was made with government support under Contract No. DE-AR0000979 awarded by the Department of Energy. The government has certain rights in the invention.

FIELD

The present disclosure is generally related to pumps for pumping a liquid metal, systems for filling a container with a liquid metal, and methods for filling a container with a liquid metal. More particularly, in some aspects, present disclosure is related to pumps for pumping liquid alkali metals, systems for filling a heat pipe (e.g., a heat pipe used for heat transfer in a nuclear micro reactor) with a liquid alkali metal, and methods for filling a heat pipe with a liquid alkali metal.

SUMMARY

According to various aspects, the present disclosure provides a pump for pumping liquid metal. The pump can include an actuator, a first plate, a second plate, guide rods, a traveling stage, and a bellows. The actuator can include a drive rod. The first plate can support the actuator. The second plate can define an intake port and a discharge port. The guide rods can extend between and be coupled to the first plate and the second plate. The traveling stage can be slidable along the guide rods intermediate the first plate and the second plate. The traveling stage can be operatively coupled to the drive rod. The bellows can extend between and be hermetically sealed to the second plate and the traveling stage to define a bellows chamber. The actuator can be configured to slide the traveling stage toward the first plate to a first position to expand the bellows chamber and cause the liquid metal to flow through the intake port and into the bellows chamber. The actuator can be further configured to slide the traveling stage toward the second plate to a second position to contract the bellows chamber and cause the liquid metal to flow out of the bellows chamber and through the discharge port.

According to various aspects, the present disclosure provides a method for filling a container with a metal using a filling system. The filling system can include a supply tank at least partially filled with the metal, a pump, a filling chamber, a first line for fluid communication between the supply tank and the pump, and a second line for fluid communication between the pump and the filling chamber. The method can include loading the container into the filling chamber, applying a vacuum to the filling chamber, and heating the filling chamber to a liquid-phase temperature of the metal. The method can further include heating the supply tank to the liquid-phase temperature of the metal to liquefy the metal and heating the pump, the first line, and the second line to the liquid-phase temperature of the metal. The method can further include pressurizing the supply tank to cause the metal to flow from the supply tank and fill the pump, the first line, and the second line. The method can further include cycling the pump for a predetermined number of cycles to fill the container with the metal.

According to various aspects, the present disclosure provides a system for filling a container with a metal. The system can include a supply tank, a bellows pump, a filling chamber, a first line, a second line, and an oven. The supply tank can be at least partially fillable with the metal. The bellows pump can be configured to pump a predetermined volume of the metal from the supply tank to the container. The filling chamber can be configured to least partially enclose the container. The first line can be configured for fluid communication between the supply tank and the bellows pump. The second line can be configured for fluid communication between the bellows pump and the filling chamber. The oven can be configured to heat at least one of the supply tank, the bellows pump, the first line, the second line, or a combination thereof to a liquid-phase temperature of the metal.

BRIEF DESCRIPTION OF THE DRAWINGS

The various aspects described herein, together with objects and advantages thereof, may best be understood by reference to the following description, taken in conjunction with the accompanying drawings as follows.

Figure 1:
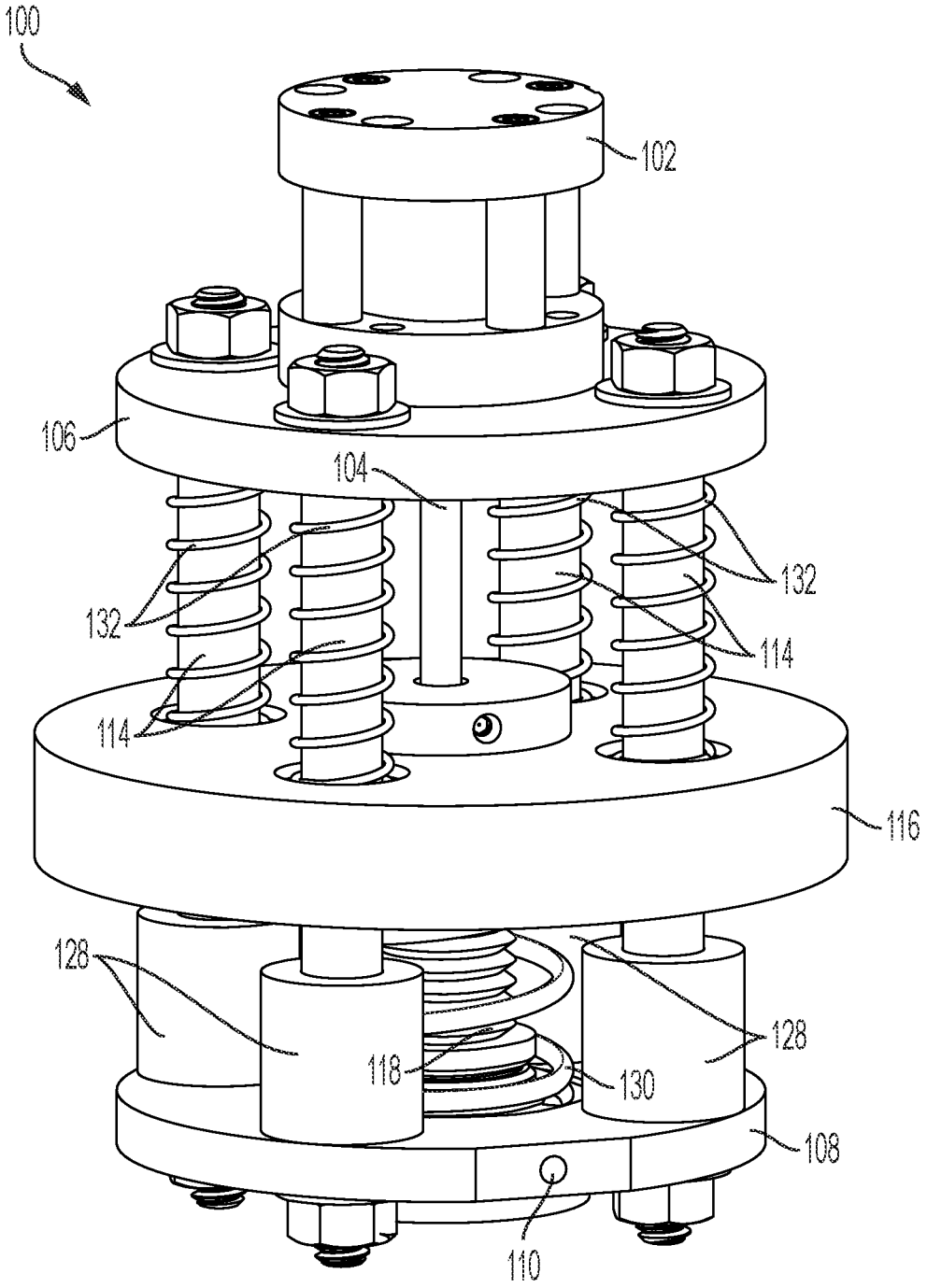
FIG. 1 is a perspective view of bellows pump, according to at least one non-limiting aspect of this disclosure.

Corresponding reference characters indicate corresponding parts throughout the several views. The exemplifications set out herein illustrate various aspects of the present disclosure, in one form, and such exemplifications are not to be construed as limiting the scope of any of the aspects disclosed herein.

DETAILED DESCRIPTION

Numerous specific details are set forth to provide a thorough understanding of the overall structure, function, manufacture, and use of the aspects as described in the disclosure and illustrated in the accompanying drawings. Well-known operations, components, and elements have not been described in detail so as not to obscure the aspects described in the specification. The reader will understand that the aspects described and illustrated herein are non-limiting examples, and thus it can be appreciated that the specific structural and functional details disclosed herein may be representative and illustrative. Variations and changes thereto may be made without departing from the scope of the claims.

In the following description, like reference characters designate like or corresponding parts throughout the several views of the drawings. Also in the following description, it is to be understood that such terms as "forward," "rearward," "left," "right," "above," "below," "upwardly," "downwardly," and the like are words of convenience and are not to be construed as limiting terms.

Generally, heat pipes are devices that rely on latent heat transfer associated with liquid-to-gas and gas-to-liquid phase transition to absorb heat from a first location and release heat at a second location. Heat pipes can be used to facilitate heat transfer in a wide variety of applications. For example, electronic devices and systems such as laptops, phones, satellites, enclosure cooling systems, and avionics systems may employ heat pipes to facilitate heat removal.

Heat pipes may also be employed in nuclear reactors to facilitate heat transfer. For example, a nuclear micro reactor may include multiple high-temperature, high-performance alkali metal heat pipes to transfer heat from the reactor core to heat exchangers external to the core. In this context, each of the reactor heat pipes is filled with an alkali metal, such as sodium. Heat from the reactor is transferred to a first end of the heat pipe, causing the alkali metal to transition from a liquid to a vapor phase. The vapor-phase alkali metal travels to a second end of the heat pipe where it condenses back to a liquid phase, thereby releasing heat. The liquid-phase alkali metal then travels back to the first end of the heat pipe through capillary action where it can again be evaporated to remove heat from the reactor core. Examples of heat pipes can be found in U.S. Patent Application Publication No. 2021/0325122, title METHOD OF INSTALLING A HEAT PIPE WICK INTO A CONTAINER OF DIFFERING THERMAL EXPANSION COEFFICIENT, published Oct. 21, 2021, which is incorporated by reference herein in its entirety.

It can be difficult to manufacture alkali metal heat pipes, for example, because it can be difficult to fill a heat pipe with the alkali metal. Alkali metals generally exist as solids under standard conditions. Accordingly, existing methods of filling heat pipes with alkali metal typically employ an oven or furnace to heat a filling system that includes a reservoir of solid alkali metal. Heating the filling system liquefies the alkali metal. Further, because conventional pumps are not suitable for pumping liquid alkali metal, inert gas is injected into the reservoir in an attempt to force a desired volume of the liquid alkali metal from the reservoir, through the filling system, to the heat pipe.

There can be numerous challenges associated with existing methods of filling heat pipes with alkali metal. For example, extensive manipulation of manual valves inside the heated oven or furnace is typically required to transport the alkali metal from the reservoir to the heat pipe. Further, the inert gas used to force the alkali metal into the heat pipe may inadvertently enter the heat pipe along with the alkali metal and need to be removed. As another example, the volume of alkali metal injected into the heat pipe can be inaccurate. As yet another example, the filling system is typically constructed to inject a specific volume of alkali metal that cannot be adjusted. Thus, a new filling system typically needs to be constructed if a different sized heat pipe needs to be filled. Moreover, each filling system may not be reusable.

Given these challenges, filling heat pipes with alkali metal using existing methods can be costly and time consuming. For example, because achieving a minimum volume of alkali metal inside the heat pipe can be critical for performance, a larger-than-required injection volume is typically applied to the heat pipe to account for the above-mentioned volume inaccuracies, which can increase material costs. Further, extensive labor and time can be required to construct each new filling system (e.g., 1-2 engineers and 1 laboratory technician working 2-4 hours to setup the filling system and fill 1 heat pipe). Accordingly, there exists an unsolved need for devices capable of pumping liquid alkali metals, systems for filling heat pipes with alkali metals, and methods for filling heat pipes with liquid alkali metals.

The present disclosure provides bellows pumps for pumping liquid metals (e.g., liquid alkali metals), systems for filling containers (e.g., heat pipes) with liquid metals, and methods for filling containers with liquid metals. The bellows pumps, systems, and methods disclosed herein can provide numerous benefits, as explained further throughout the present disclosure. For example, the pumps, systems, and methods disclosed herein can enable the heat pipe filling process to be automated through the use of an actuated pump. Moreover, as a result of the automation, a furnace and/or oven used to heat the system may not need to be entered by operators for manual manipulation of valves, thereby enhancing safety, reducing the potential for human error, reducing downtime, and saving costs. As yet another example, the pumps, systems, and methods can enable a more precise and accurate volume of alkali metal to be applied to the heat pipe compared to existing methods. As yet another example, the pumps and systems can be reused to fill multiple heat pipes and can be adjusted to supply different predetermined volumes of the alkali metal to accommodate heat pipes of different sizes. As yet another example, the pumps described herein can be constructed with removable and adjustable parts, allowing for easy maintenance, repair, and/or calibration.

Figure 2:
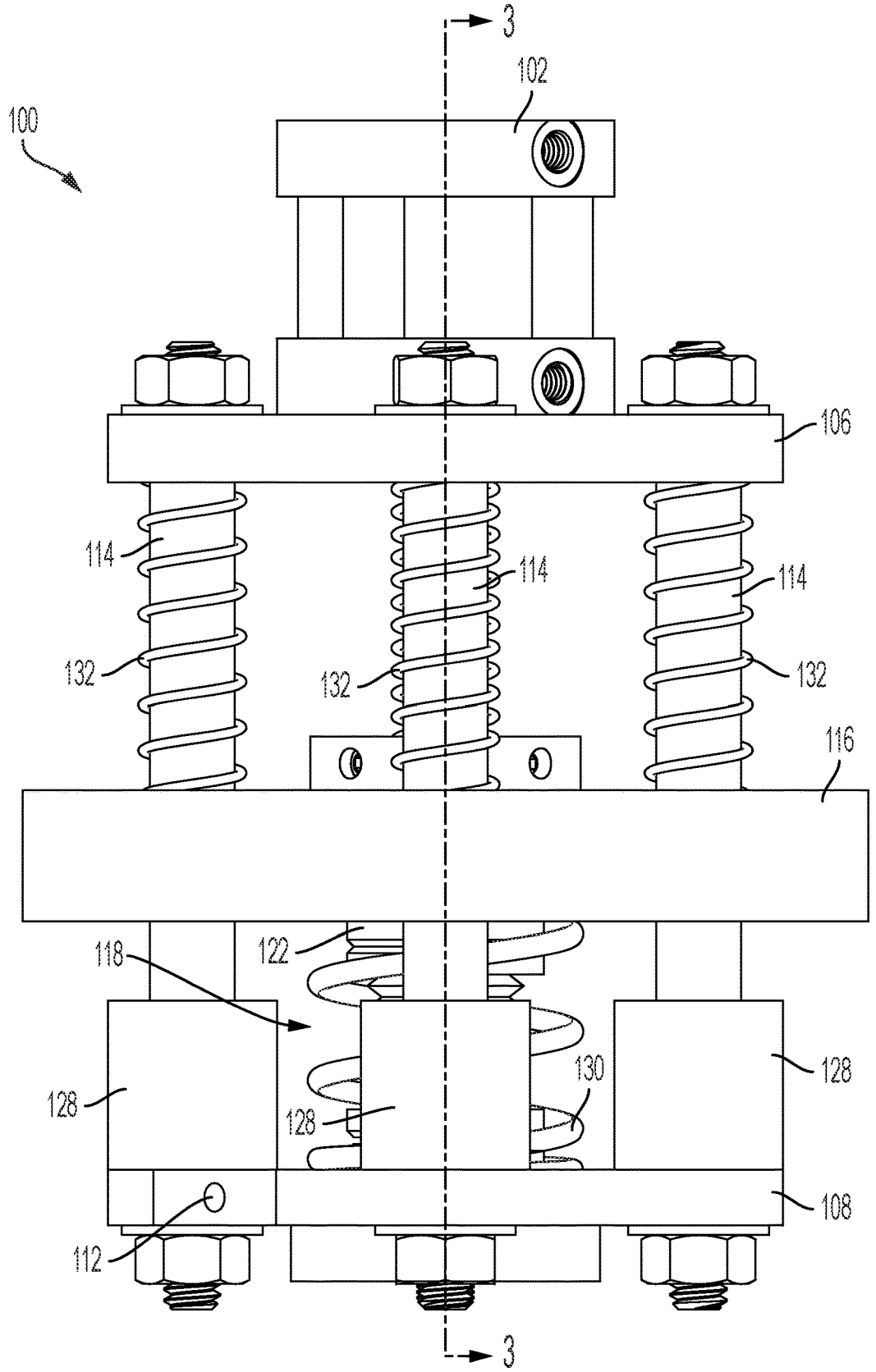
FIG. 2 is a side view of the bellows pump of FIG. 1, according to at least one non-limiting aspect of this disclosure.
Figure 3:
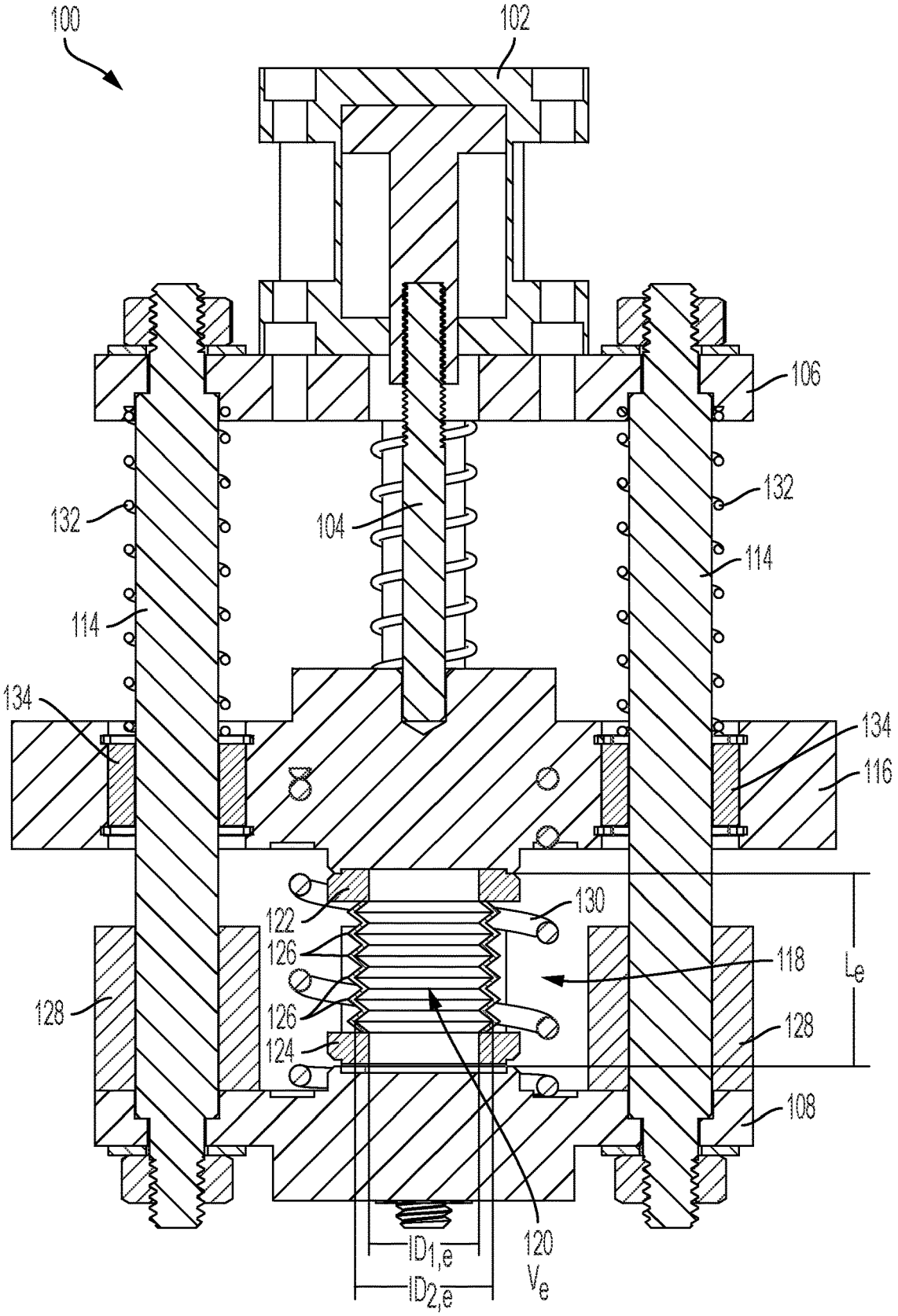
FIG. 3 is a cross sectional view of the bellows pump of FIG. 1, taken along section 3-3 of FIG. 2, with the bellows in an expanded configuration, according to at least one non-limiting aspect of this disclosure.

FIGS. 1-3 illustrate a bellows pump 100, according to at least one non-limiting aspect of this disclosure. FIG. 1 is a perspective view of the bellows pump 100, FIG. 2 is a side view of the bellows pump 100, and FIG. 3 is a cross sectional view of the bellows taken along section 3-3 of FIG. 2.

Referring to FIGS. 1-3, the bellows pump 100 can include a first plate 106, a second plate 108, and one or more guide rods 114 extending between the first plate 106 and the second plate 108. In the non-limiting aspect of FIGS. 1-3, the bellows pump 100 includes four guide rods 114. In other aspects, the bellows pump 100 can include less than four guide rods 114 (e.g., 1, 2, or 3 guide rods) or more than four guide rods 114 (e.g., 5, 6, 7 or 8 guide rods).

Each of the guide rods 114 can be coupled to the first plate 106 and the second plate 108. In one aspect, each of the guide rods 114 is removably coupled to at least one of the first plate 106 or the second plate 108. For example, as best shown in FIG. 1, the ends of each of the guide rods 114 may include a threaded rod that is insertable through a corresponding hole in the first plate 106 or the second plate 108. The threaded rod can be fastened to a corresponding threaded nut, thereby removably coupling the corresponding one of the guide rods 114 to the first plate 106 and/or the second plate 108. Removably coupling each of the guide rods 114 to at least one of the first plate 106 or the second plate 108 can enable the bellows pump 100 to be easily assembled and disassembled for purposes such as maintenance, repair, and/or adjustment of the stops 128, which are described further herein. In another aspect, one or both of the ends of each guide rod 114 can be welded to the first plate 106 and/or the second plate 108. The first plate 106, the second plate 108, and the guide rods 114 can generally define a support structure of the bellows pump 100.

In some aspects, passages (e.g., holes) formed in the second plate 108 can define an intake port 110 (FIG. 1) and a discharge port 112 (FIG. 2) of the bellows pump 100. The discharge port 112 can be disposed in the second plate 108 opposite the intake port 110.

Referring still to FIGS. 1-3, the bellows pump 100 can include a traveling stage 116. The traveling stage 116 is slidable along the guide rods 114 intermediate the first plate 106 and the second plate 108. For example, the traveling stage 116 can include holes corresponding to each of the guide rods 114, and through which the guide rods 114 are insertable, thereby enabling the traveling stage 116 to slide along the guide rods 114. In some aspects, as best shown in FIG. 3, the traveling stage 116 can include bushings 134 to enable the traveling stage 116 to slide smoothly along the guide rods 114.

The bellows pump can include an actuator 102. The actuator 102 can be supported by or otherwise coupled to the first plate 106. The actuator 102 can be configured to cause the traveling stage 116 to slide along the guide rods 114. For example, as best shown in FIG. 3, the actuator 102 can include a drive rod 104 that is coupled to the traveling stage 116. Actuating the actuator 102 can translate the drive rod 104, thereby causing the traveling stage 116 to slide along the guide rods 114.

The actuator 102 may be actuated in a first manner and a second manner. Actuating the actuator in the first manner can cause the traveling stage 116 to slide in a first direction toward the first plate 106. Actuating the actuator in the second manner can cause the traveling stage 116 to slide in a second direction toward the second plate 108. In some aspects, the actuator 102 can be a pneumatically actuated actuator, such as a tie rod air cylinder, as shown in FIG. 3. In other aspects, the actuator 102 can be another type of actuator, such as a hydraulic actuator or an electric actuator. In some aspects, the actuator 102 can be dual acting. In other aspects, the actuator 102 can be single acting with a spring return.

The bellows pump 100 and the actuator 102 can be configured such that the traveling stage 116 is normally in (e.g., biased to, fails to) a first position proximate the first plate 106 (e.g., the configuration shown in FIG. 3) and is slidable to a second position proximate the second plate 108 (e.g., the configuration shown in FIG. 4) by actuating the actuator 102. For example, as explained further herein, the bellows pump 100 can include a bellows 118. The bellows 118 may exert a spring force on the traveling stage 116 that biases the traveling stage to the first position (FIG. 3). As another example, as explained further herein, the pump can include a spring 130. The spring 130 and/or the bellows 118 may exert a spring force on the traveling stage 116 that biases the traveling stage 116 to the first position (FIG. 3). As yet another example, the actuator 102 can include a spring that biases the traveling stage 116 to the first position (FIG. 3). In other aspects, the bellows pump 100 and the actuator 102 can be configured such that the traveling stage 116 is normally in the second position proximate the second plate 108.

Referring again to FIGS. 1-3, the bellows pump 100 can include a bellows 118. The bellows 118 extends between and is coupled to the second plate 108 and the traveling stage 116. As best shown by FIG. 3, the bellows 118 (e.g., the bellows 118, the traveling stage 116, and the second plate 108) can define a bellows chamber 120. In some aspects, the bellows 118 is hermetically sealed to the second plate 108 and the traveling stage 116, for example, by welding the bellows 118 to the second plate 108 and the traveling stage 116. In some aspects, a first flange 122 of the bellows 118 is welded to the traveling stage 116 to hermetically seal the bellows 118 to the traveling stage 116. In some aspects, a second flange 124 of the bellows is welded to the second plate 108 to hermetically seal the bellows 118 to the second plate 108. Welding the bellows 118 to the second plate 108 and the traveling stage 116 can create a hermetically sealed bellows chamber 120 without the use of o-rings, bushing, gaskets, and/or the like. Welding the bellows 118 to the second plate 108 and the traveling stage 116 to create a hermetically sealed bellows chamber 120 without the use of o-rings, bushing, gaskets, and/or the like can enable the bellows pump 100 to be suitable for pumping liquid metals, such as liquid alkali metals (e.g., liquid sodium).

Figure 4:
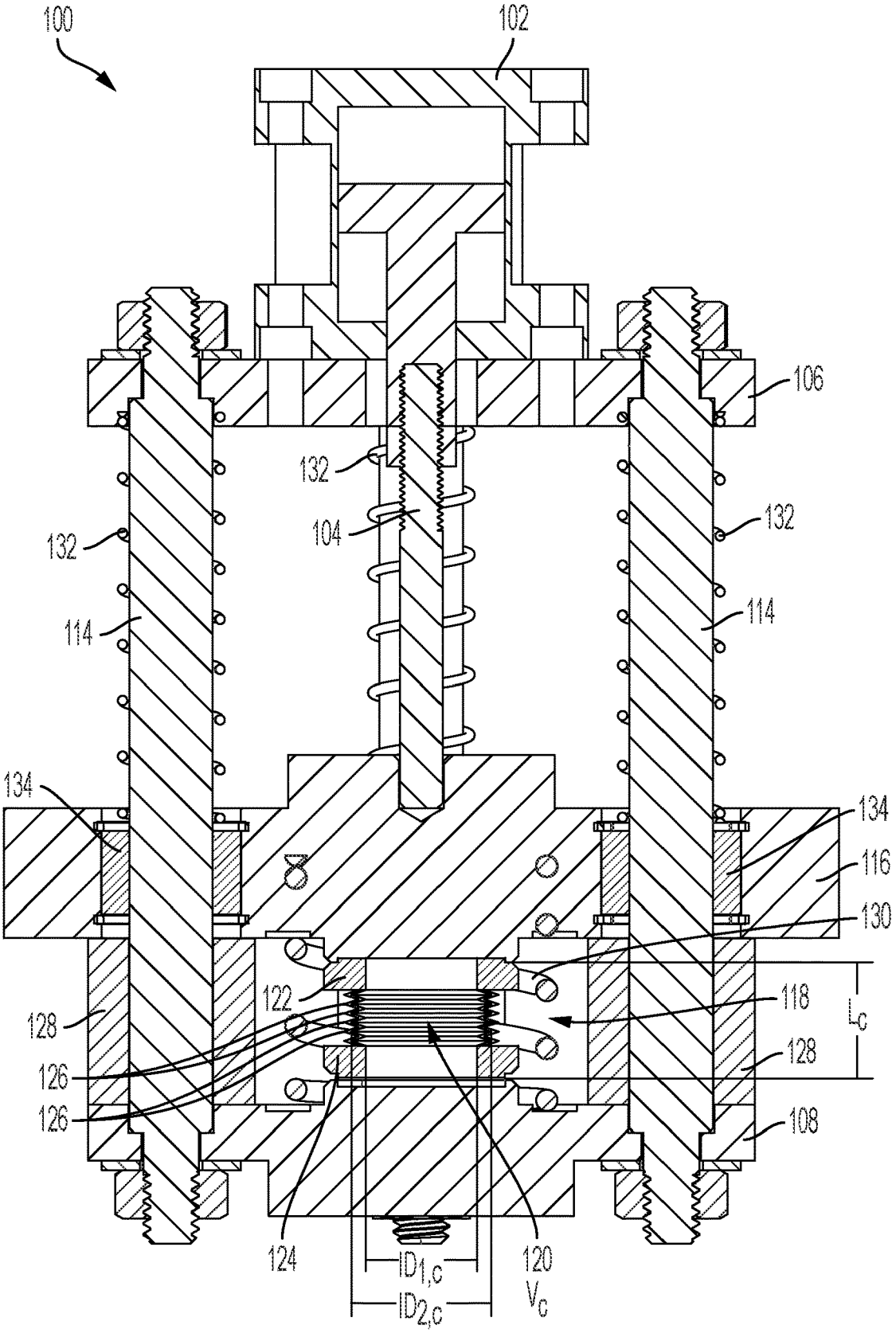
FIG. 4 is another a cross sectional view of the bellows pump of FIG. 1 taken along section 3-3 of FIG. 2, with the bellows in a compressed configuration, according to at least one non-limiting aspect of this disclosure.

As noted above, FIG. 3 is a cross sectional view of the bellows pump 100 taken along section 3-3 of FIG. 2. FIG. 3 shows the traveling stage 116 in a first position proximate the first plate 106. FIG. 4 is another a cross sectional view of the bellows pump 100 showing the traveling stage 116 in a second position proximate the second plate 108, according to at least one non-limiting aspect of the present disclosure. As also noted above, the actuator 102 can cause the traveling stage 116 to slide between the first position and the second position. Sliding the traveling stage 116 to the first position can cause the bellows chamber 120 to be in an expanded configuration (FIG. 3) and sliding the traveling stage to the second position can cause the bellows chamber 120 to be in a contracted configuration (FIG. 4).

During an intake stroke of the bellows pump 100, the bellows chamber 120 is expanded, thereby causing liquid to flow through the intake port 110 and into the bellows chamber 120. During a discharge stroke of the bellows pump 100, the bellows chamber is contracted, thereby causing liquid to flow out of the bellows chamber 120 and through the discharge port 112. Each intake stroke and corresponding discharge stroke can define a single cycle of the bellows pump 100.

Referring primarily to FIGS. 3 and 4, the bellows 118 can include convolutions 126. Each of the convolutions 126 has a first inner diameter $ID_1$ and a second inner diameter $ID_2$. Further, the bellows 118 has a length L. The first inner diameter $ID_1$, the second inner diameter $ID_2$, and the length L can define a volume of the bellows chamber 120. The first inner diameter $ID_1$, the second inner diameter $ID_2$, and the length L can be configured to precisely control the volume of liquid displaced by a single cycle of the bellows pump 100 (e.g., the stroke volume $V_s$ of the bellows pump 100).

For example, expanding and contracting the bellows 118 can cause the length L, the first inner diameter $ID_1$, and/or the second inner diameter $ID_2$ to change, thereby changing the volume of the bellows chamber 120. When in the expanded configuration shown in FIG. 3, the bellows 118 can have an expanded length $L_e$. When in the contracted configuration shown in FIG. 4, the bellows 118 can have a contracted length $L_c$ that is less than the expanded length $L_e$. In some aspects, the first inner diameter $ID_1$ may transition between an expanded first inner diameter $ID_{1,e}$ and a contracted first inner diameter $ID_{1,c}$. In some aspects, the second inner diameter $ID_2$ may transition between an expanded second inner diameter $ID_{2,e}$ and a contracted second inner diameter $ID_{2,c}$. The expanded length $L_e$, the expanded first inner diameter $ID_{1,e}$, and/or the expanded second inner diameter $ID_{1,e}$ can define an expanded volume $V_e$ of the bellows chamber 120. The contracted length $L_c$, the contracted first inner diameter $ID_{1,c}$, and/or the contracted second inner diameter $ID_{1,c}$ can define a contracted volume $V_c$ of the bellows chamber 120. The contracted volume $V_c$ is less than the expanded volume $V_e$. Thus, the stroke volume can be calculated by subtracting the contracted volume $V_c$ from the expanded volume $V_e$ (e.g., $V_s=V_e-V_c$).

The lengths $L_e$, $L_c$, the first inner diameters $ID_{1,e}$, $ID_{1,c}$, and/or the second inner diameters $ID_{2,e}$, $ID_{2,c}$ can be configured to achieve a desired expanded volume $V_e$ and a desired contracted volume $V_c$ of the bellows chamber 120, thereby achieving a desired or predetermined stroke volume $V_s$ of the bellows pump 100. Moreover, by operating the bellows pump 100 for a predetermined number of cycles $N_{cycle}$, with each cycle supplying the predetermined stroke volume $V_s$, the bellows pump 100 can be used to supply a precise total volume $V_T$ (e.g., $V_T=V_s \times N_{cycle}$) of liquid (e.g., to fill a container). Thus, in some aspects, the bellows pump 100 can be used to deliver a precise total volume $V_T$ of liquid alkali metal (e.g., liquid sodium) to fill a heat pipe.

In some aspects, the bellows 118 can be a welded bellows, with each leaf of the convolutions 126 being edge welded to an adjacent leaf, or in the case of the leafs of the endmost convolutions 126, edge welded to one of the first flange 122 or the second flange 124. In other aspects, the bellows 118 can be a formed bellows, with the convolutions 126 being formed from a forming die. However, a welded bellows can allow more, smaller convolutions to be constructed over a given length compared to a formed bellows, which can enable more precise control of the stroke volume $V_s$. In addition to or in lieu of the above, a welded bellows can enable improved cyclic capability (e.g., durability) and/or an improved pressure rating compared to a formed bellows. Furthermore, in some aspects, the bellows 118 can be double walled, which can enable improved cyclic capability and an improved pressure rating compared to a single-walled bellows. Thus, the welded construction of the bellows 118 can enable the bellows pump 100 to be suitable for pumping liquid metals, such as liquid alkali metals (e.g., liquid sodium).

Referring to FIGS. 1-4, the bellows pump can include stops 128. Each of the stops 128 can be removably disposed about a corresponding one of the guide rods 114 intermediate the second plate 108 and the traveling stage 116. In some aspects, the stops 128 can be used to control the stroke volume $V_s$ by preventing the traveling stage 116 from sliding beyond the second position (FIG. 4) toward the second plate. For example, as the bellows pump 100 is cycled from the first position (FIG. 3) to the second position (FIG. 4), the stops 128 can contact the traveling stage 116, thereby setting the contracted length $L_c$ of the of the bellows 118 and defining the contracted volume $V_c$ of the bellows chamber 120. As described above, the bellows pump 100 can be disassembled by, for example, decoupling the second plate 108 and the guide rods 114. Different size stops 128 can be interchangeably installed to achieve a different contracted length $L_c$ of the of the bellows 118 and a different contracted volume $V_c$. Thus, the stops 128 can be interchanged to achieve a desired stroke volume $V_s$.

In some aspects, the stops 128 can be constructed of a material that has a thermal expansion coefficient that is substantially the same as or greater than that of the material (s) of the other components of the bellows pump 100 (e.g., the material of the first plate 106, the material of the second plate 108, the material of the traveling stage 116, the material of the guide rods 114). When being used to pump a liquid alkali metal, the bellows pump 100 may be heated to a liquid-phase temperature of the alkali metal. Constructing the stops 128 of a material that has a thermal expansion coefficient that is substantially the same as or greater than that of the material(s) of the other components of the bellows pump 100 can enable the dimensions of the stops 128 to change in proportion to the dimensions of the other components of the bellows pump 100 as the bellows pump 100 is heated. Thus, constructing the stops 128 of a material that has a thermal expansion coefficient that is substantially the same as or greater than that of the material(s) of the other components of the bellows pump 100 can cause a predictable change in the contracted length $L_c$ as the bellows pump 100 is heated, thereby enabling precise control of the stroke volume $V_s$.

In some aspects, the stops 128 can be constructed of a non-metal material, such as a thermoplastic material. For example, the stops 128 can be constructed of polyetheretherketone (PEEK). Constructing the stops 128 of a non-metal material, such as a thermoplastic material, can enable a soft landing of the traveling stage 116 as it contacts the stops 128 during cycling of the bellows pump 100.

Referring still to FIGS. 1-4, in some aspects, the bellows pump 100 can include a spring 130 positioned intermediate the second plate 108 and the traveling stage 116. In some aspects, as shown in FIGS. 1-4, the spring 130 can be disposed about the bellows 118. The spring 130 can exert a spring force on the traveling stage 116 that, in concert with the actuator 102, causes the traveling stage 116 to transition to the first position and causes the bellows 118 to transition to the expanded configuration (FIG. 3). As explained further herein, the spring 130 can bias the traveling stage 116 to the first position.

Referring still to FIGS. 1-4, in some aspects, the bellows pump 100 can include one or more springs 132 positioned intermediate the first plate 106 and the traveling stage 116. In some aspects, as shown in FIGS. 1-4, each of the one or more springs 132 can be disposed about a corresponding one of the guide rods 114. The one or more springs 132 can exert a spring force on the traveling stage 116 that counteracts and/or balances the spring force applied by the spring 130, the bellows 118, and/or a spring of the actuator 102. In some aspects, the one or more springs 132 can provide resistance to enable the traveling stage 116 to smoothly transition for the first position (FIG. 3) (e.g., without the drive rod 104 slamming against the internals of the actuator 102).

The bellows pump 100 can be suited for pumping liquid metals and liquid metal alloys, such as liquid alkali metals (e.g., liquid sodium). For example, some metals and metal alloys (e.g., sodium-potassium alloy, sometimes referred to as NaK; mercury) can exist in liquid phase a standard temperature and pressure conditions. Thus, in some aspects, the bellows pump 100 can be suited for pumping liquid metals at standard conditions. High temperatures (e.g., greater than 100° C., such as 100° C. to 200° C., greater than 120° C., or 120° C. to 200° C.) and vacuum conditions (e.g., pressures less than 102 kPa, such as, for example, high-vacuum condition which can include pressures less than 0.000133 kPa) can be required to maintain alkali metals and other metals or metal alloys in a liquid phase. Thus, in some aspects, the bellows pump 100 can be configured to withstand the high temperatures (e.g., greater than 100° C., such as 100° C. to 200° C., greater than 120° C., or 120° C. to 200° C.) and vacuum conditions (e.g., pressures less than 102 kPa, such as, for example, high-vacuum condition which can include pressures less than 0.000133 kPa) that can be required to maintain alkali metals and other liquid metals or metal alloys in a liquid phase. Furthermore, in some aspects, the bellows pump 100 can be configured to be chemically compatible with (e.g., corrosion resistant to) liquid alkali metals.

Accordingly, any of the components of the bellows pump 100, such as the actuator 102, the drive rod 104, the first plate 106, the second plate 108, the traveling stage 116, the bellows 118, the spring 130, and/or the spring 132 can be constructed of material configured to withstand a temperature and pressure of a liquid phase of an alkali metal. Any of wetted components of the bellows pump 100 (e.g., the bellows 118, the second plate 108, the traveling stage 116)

can be constructed of a material that is configured to be chemically compatible with (e.g., corrosion resistant to) a liquid alkali metal. For example, any of the actuator 102, the drive rod 104, the first plate 106, the second plate 108, the traveling stage 116, the bellows 118, the spring 130, and/or the spring 132 can be constructed of an austenitic stainless steel, such as, for example, 304, 316, 347 stainless steel or other species of 300 series stainless steel; martensitic steel, such as, for example, species of 400 series stainless steel; or other suitable metal or metal alloys such as, for example austenitic nickel-chromium-based alloys (e.g., alloys known under the trade name Inconel) or precipitation-hardened steels.

Figure 5:
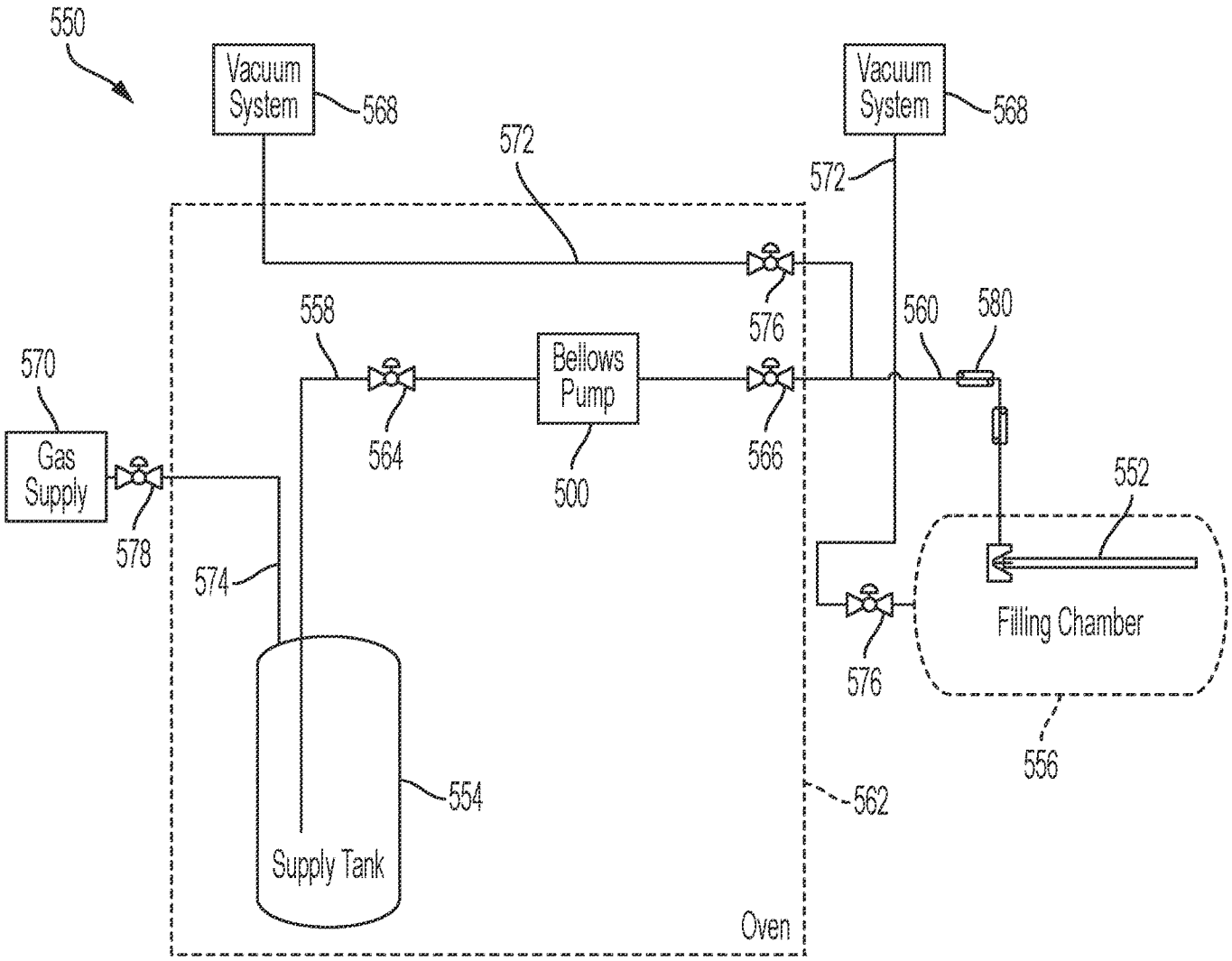
FIG. 5 is a schematic diagram of a system for filling a container with a metal, according to at least one non-limiting aspect of this disclosure.

FIG. 5 is a schematic diagram of a system 550 for filling a container 552 with a metal, according to at least one non-limiting aspect of this disclosure. The container 552 can be any type of tube, canister, tank, measuring device, sensor, medical device, pipe, and/or other type of container for holding a volume of material. For example, the container 552 can be a heat pipe, such as a heat pipe configured for use in a nuclear reactor (e.g., a modular reactor, a mini reactor, a micro reactor, a space reactor). The system 550 can be configured to fill the container 552 with various types of metal, such as, for example, alkali metals (e.g., sodium, potassium, cesium, rubidium, lithium, francium, sodium-potassium alloy (NaK)) or other types of metals and metal alloys (e.g., bismuth, tin, mercury, alloys of any combination thereof, eutectic alloys).

The system 550 can include a bellows pump 500, a supply tank 554, a filling chamber 556, a first line 558 for fluid communication between the supply tank 554 and the bellows pump 500, a second line 560 for fluid communication between the bellows pump 500 and the filling chamber 556, and an oven 562.

The bellows pump 500 can be configured to pump the metal (e.g., a metal in liquid phase, an alkali metal in liquid phase) from the supply tank 554 to the container 552. In some aspects, the bellows pump 500 can be configured the same or similar to the bellows pump 100 described further herein. Thus, the bellows pump 500 can be configured to be chemically compatible with a liquid alkali metal. Further, the bellows pump 500 can be configured to withstand the high temperatures (e.g., greater than 100° C., such as 100° C. to 200° C., greater than 120° C., or 120° C. to 200° C.) and vacuum conditions (e.g., pressures less than 102 kPa, such as, for example, high-vacuum condition which can include pressures less than 0.000133 kPa) that can be required to maintain alkali metals and/or other metals or metal alloys in a liquid phase.

The bellows pump 500 can include a bellows chamber that is actuatable between an expanded configuration and a contracted configuration. Actuating the bellows chamber between the expanded configuration and the contracted configuration can respectively correspond to an intake stroke and a discharge stoke of the bellows pump 500. Each intake and corresponding discharge stroke of the bellows pump 500 can define a single cycle of the pump. With each cycle, the bellows pump 500 can pump a predetermined volume of the metal (e.g., a stroke volume $V_s$) from the supply tank 554 to the container 552. Further, based on the stroke volume $V_s$ and the volume of the container 552, the bellows pump 500 can cycled for a predetermined number of cycles $N_{cycle}$ to fill the container 552 with the metal.

The supply tank 554 can serve as a reservoir to supply the metal that is pumped by the bellows pump 500 to fill the container 552. The supply tank 554 is at least partially fillable with the metal. In some aspects, the supply tank 554 can be provided to the system 550 at least partially filled with the metal in a sold phase.

The oven 562 can be configured to heat the supply tank 554, the first line 558, the bellows pump 500, and/or the second line 560 to a liquid-phase temperature of the metal (e.g., temperature greater than 100° C., such as 100° C. to 200° C., greater than 120° C., or 120° C. to 200° C., under vacuum or high vacuum conditions). Thus, in some aspects, the supply tank 554, the first line 558, the bellows pump 500, and/or at least a portion of the second line 560 can be positioned within the oven 562. In the non-limiting aspect of FIG. 5, a portion of the second line 560 is positioned in the oven 562. Further, a portion of the second line 560 positioned outside of the oven 562 can include heat tracing and/or insulation 580 to heat the portion of the second line 560 to the liquid-phase temperature of the metal. Heating the supply tank 554 to the liquid-phase temperature of the metal can cause the metal that at least partially fills the supply tank 554 to transition from a solid phase to a liquid phase.

In some aspects, the system 550 can include a gas supply 570 and a gas line 574 for fluid communication between the gas supply 570 and the supply tank 554. The gas supply 570 can include, for example, a gas supply bottle (e.g., filled with an inert gas such as argon) and a gas header. The gas line 574 can include an actuated isolation valve 578. Actuating the actuated isolation valve 578 can cause the supply tank 554 to be pressurized with gas from the gas supply 570. Pressurizing the supply tank 554 can force the liquid metal in the supply tank 554 to flow to the first line 558, the bellows pump 500, and the second line 560, thereby initially priming the system 550 with the liquid metal.

In some aspects, the system 550 can include one or more than one vacuum system 568 for applying a vacuum to the second line 560, the bellows pump 500, the first line 558, and/or the filling chamber 556. The system 550 can further include one or more than one vacuum line 572 for fluid communication between the one or more than one vacuum system 568, the second line 560, and/or the filling chamber 556. Each of the one or more than one vacuum line 572 may include an actuated isolation valve 576. The one or more than one vacuum system 568 can be used to apply a vacuum to the second line 560, the bellows pump 500, and/or the first line 558 prior to priming the system with the liquid metal. In some aspects, the one or more than one vacuum system 568 can be used to apply a vacuum to the filling chamber 556 prior filling the container 552 with the liquid metal.

The filling chamber 556 can include one or more than one chamber for enclosing, heating, pressurizing, and/or holding the container 552. For example, the filling chamber 556 can include a chamber that encloses the container 552 and maintains a desired temperature (e.g., temperature greater than 100° C., such as 100° C. to 200° C., greater than 120° C., or 120° C. to 200° C.) and pressure (e.g., a vacuum condition, such as a pressures less than 102 kPa; a high-vacuum condition which can include pressures less than 0.000133 kPa) for filling the containing 552 with the metal (e.g., a liquid alkali metal). In some aspects, the filling chamber 556 can include heat tracing and/or insulation for achieving and maintaining temperature. As another example, the chamber 556 can include a chamber that holds more than one container 552 and is configured to sequentially position (e.g., rotate) each of the more than one container 552 in fluid communication with the second line 560, thereby enabling each of the more than one container 552 to be rapidly filled without repriming, reheating, and/or repressurizing the system 550.

In some aspects, the first line 558 can include a first actuated valve 564 and the second line 560 can include a second actuated valve 566. The first actuated valve 564 and the second actuated valve 566 can be configured to actuate in concert with the intake and discharge strokes of the bellows pump 500. In some aspects, the first actuated valve 564 and the second actuated valve 566 can control a direction of the flow of the liquid metal. For example, the first actuated valve 564 can be configured to be open during the intake stroke and closed during the discharge stroke. This configuration of the first actuated valve 564 can ensure that liquid metal is able to flow from the supply tank 554 during the intake stroke and prevent flow of the liquid metal back to the supply tank 554 during the discharge stroke. Likewise, the second actuated valve 566 can be configured to be closed during the intake stroke and open during the discharge stroke. This configuration of the second actuated valve 566 can ensure that liquid metal is able to flow to the container 552 during the discharge stroke and prevent flow of the liquid metal from the container 552 back to the bellows pump 500 during the intake stroke. As another example, the configuration of the first actuated valve 564 and the second actuated valve 566 described above can be reversed to achieve flow of the liquid metal in the opposite direction. In some aspects, in addition to or in lieu of the first actuated valve 564 and the second actuated valve 566, the first line 558 and/or the second line 560 can include a check valve to control the directional flow of the liquid metal. Persons of ordinary skill in the art will appreciate that the system 550 can include isolation valves on the first line 558 and/or the second line 560 to isolate any of the components or valves thereon (e.g., for maintenance, startup, etc.).

Figure 6:
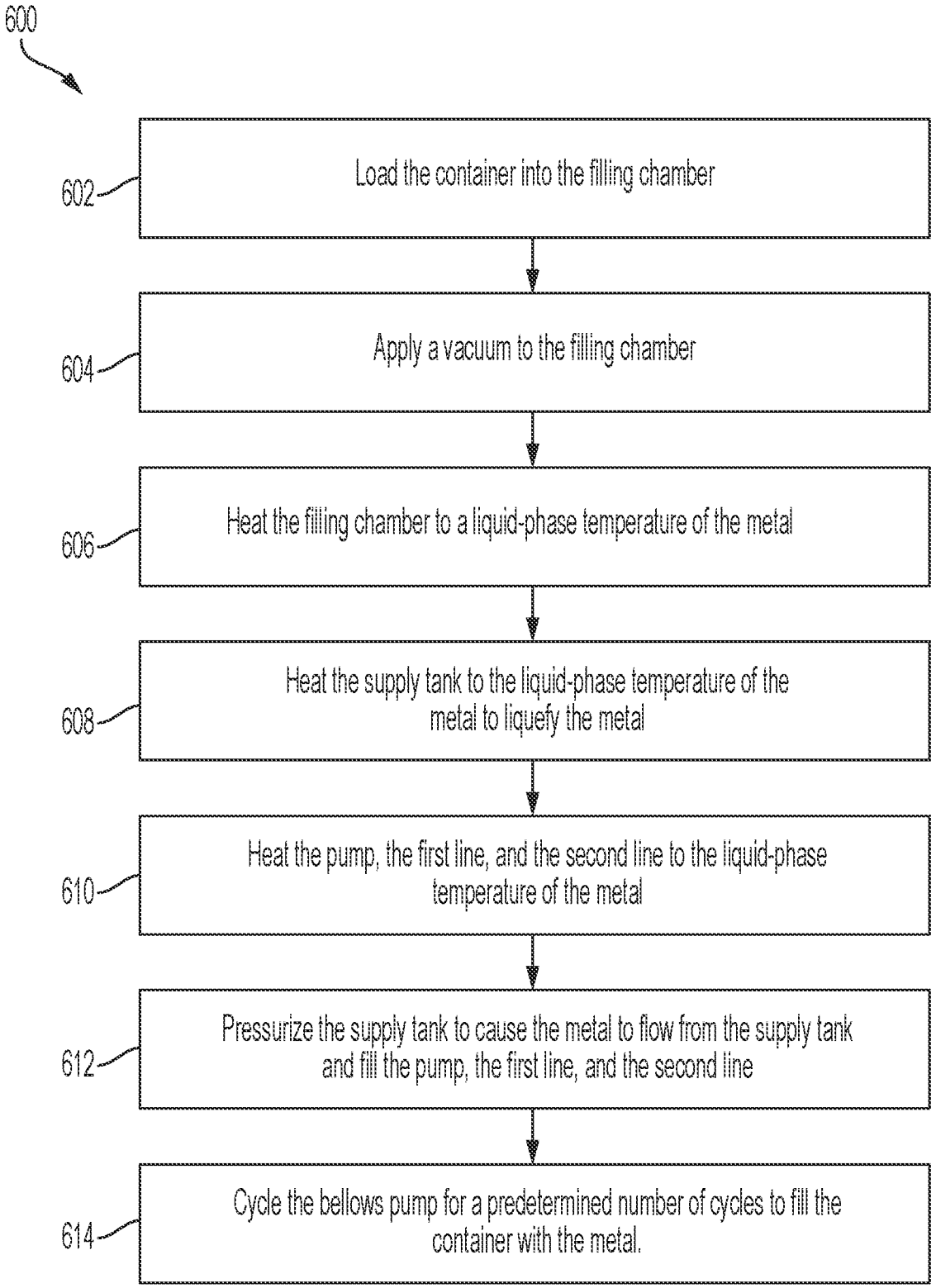
FIG. 6 illustrates a flow chart of a method for filling a container with a metal, according to at least one non-limiting aspect of this disclosure.

FIG. 6 illustrates a flow chart of a method 600 for filling the container 552 with a metal using the system 550 of FIG. 5, according to at least one non-limiting aspect of this disclosure. As noted above, the system 550 can include a supply tank 554 at least partially filled with the metal, a bellows pump 500, a filling chamber 556, a first line 558 for fluid communication between the supply tank 554 and the bellows pump 500, and a second line 560 for fluid communication between the bellows pump 500 and the filling chamber 556. As also noted above, in some aspects, the container 552 can be heat pipe and the metal can be an alkali metal (e.g., sodium). Thus, in some aspects, the method 600 can be executed to fill a heat pipe with an alkali metal.

Referring to FIGS. 5 and 6, according to the method 600, the container 552 is loaded 602 into the filling chamber 556. A vacuum is applied 604 to the filling chamber 556, for example, using the vacuum system 568. The filling chamber 556 is heated 606 to a liquid-phase temperature of the metal (e.g., a liquid-phase temperature of the alkali metal under vacuum or high vacuum conditions). In some aspects, applying 604 the vacuum can comprise achieving a pressure in the filling chamber 556 that is no greater than 102 kPa. In some aspects, heating 606 the filling chamber 556 can comprise achieving a temperature in the filling chamber 556 that is no less than 100° C., such as 100° C. to 200° C., greater than 120° C., or 120° C. to 200° C.

Still referring to FIGS. 5 and 6, according to the method 600, the supply tank 554 is heated 608 to the liquid-phase temperature of the metal to liquefy the metal. Further, the first line 558, the second line 560, and the bellows pump 500 are heated 610 to the liquid-phase temperature of the metal. In some aspects, the first line 558, at least a portion of the second line 560, and the bellows pump 500 are heated using the oven 562. In some aspects, at least a portion of the second line 560 is heated using heat tracing and/or insulation 580. In some aspects, heating 608 the supply tank 554 and/or heating 610 the first line 558, the second line 560, and the bellows pump 500 can comprise achieving a temperature in the supply tank 554, the first line 558, the second line 560, and/or the bellows pump 500 that is no less than 120° C., such as 120° C. to 200° C.

Still referring to FIGS. 5 and 6, according to the method 600, the supply tank 554 is pressurized 612 to cause the metal to flow from the supply tank 554 to fill the first line 558, the bellows pump 500, and the second line 560. In some aspects, the supply tank 554 is pressurized 612 with inert gas using the gas supply 570.

Still referring to FIGS. 5 and 6, according to the method 600, the bellows pump 500 is cycled 614 for a predetermined number of cycles ($N_{cycle}$) to fill the container with the metal. For example, each cycle of the bellows pump 500 can supply a predetermined stroke volume $V_s$. Further, a total volume $V_T$ may be required to fill the container. Thus, by cycling 614 the bellows pump 500 for the predetermined number of cycles ($N_{cycle}$), the bellows pump 500 can be used to supply the precise total volume $V_T$ of liquid (e.g., $V_T = V_s \times N_{cycle}$) to fill the container 552.

As noted above, the bellows pump 500 can include a bellows chamber that is expanded and contracted during a single cycle of the bellows pump 500. Further, the first line 558 can include a first actuated valve 564 and the second line can include a second actuated valve 566. According to some aspects of the method 600, cycling 614 the bellows pump 500 for the predetermined number of cycles $N_{cycle}$ to fill the container 552 with the metal can include closing the second actuated valve 566, expanding the bellows chamber to cause a predetermined volume of metal $V_s$ to enter the bellows chamber, closing the first actuated valve 564, opening the second actuated valve 566, and contracting the bellows chamber to cause the predetermined volume $V_s$ of metal to exit the bellows chamber, thereby causing the predetermined volume of the metal $V_s$ to enter the container 552.

In some aspects, the bellows pump 500 can further include an actuator, a first plate supporting the actuator, a second plate, guide rods extending between the first plate and the second plate, a traveling stage operatively coupled to the actuator and slidable along the guide rods intermediate the first plate and the second plate, and a bellows extending between and hermetically sealed to the second plate and the traveling stage to define the bellows chamber. According to some aspects of the method 600, expanding the bellows chamber can include applying a first action by the actuator to slide the traveling stage toward the first plate to a first position. Further, contracting the bellows chamber can include applying a second action by the actuator to slide the traveling stage toward the second plate to a second position.

Various examples of the devices, systems, and methods described herein are set out in the following clauses.

To be updated based on the approved claims.

Clause 1: A pump for pumping liquid metal, the pump comprising: an actuator comprising a drive rod; a first plate supporting the actuator; a second plate defining an intake port and a discharge port; guide rods extending between and coupled to the first plate and the second plate; a traveling stage slidable along the guide rods intermediate the first plate and the second plate, the traveling stage operatively coupled to the drive rod; a bellows extending between and hermetically sealed to the second plate and the traveling stage to define a bellows chamber; wherein the actuator is configured to slide the traveling stage toward the first plate to a first position to expand the bellows chamber and cause the liquid metal to flow through the intake port and into the bellows chamber; and wherein the actuator is configured to slide the traveling stage toward the second plate to a second position to contract the bellows chamber and cause the liquid metal to flow out of the bellows chamber and through the discharge port.

Clause 2: The pump of Clause 1, wherein the second plate comprises a second plate material, wherein the traveling stage comprises a traveling stage material, wherein the bellows comprises a bellows material, wherein each of the second plate material, the traveling stage material, and the bellows material are chemically compatible with a liquid alkali metal, and wherein each of the second plate material, the traveling stage material, and the bellows material are selected to withstand a temperature and pressure of a liquid phase of the liquid alkali metal.

Clause 3: The pump of Clause 2, wherein the liquid alkali metal comprises sodium, potassium, cesium, rubidium, lithium, or francium, or an alloy of any combination thereof.

Clause 4: The pump of Clause 3, wherein the second plate material, the traveling stage material, and the bellows material each comprise austenitic stainless steel.

Clause 5: The pump of any one of Clauses 1-4, wherein the bellows comprises: a first flange welded to the traveling stage to hermetically seal the bellows to the traveling stage; a second flange welded to the second plate to hermetically seal the bellows to the second plate; and convolutions intermediate the first flange and the second flange.

Clause 6: The pump of any one of Clauses 1-5, wherein the bellows chamber has a first volume when the traveling stage is in the first position and a second volume when the traveling stage is in the second position, and wherein a stroke volume of the pump is defined based on a difference between the first volume and the second volume, the pump further comprising: stops removably disposed about the guide rods intermediate the second plate and the traveling stage, wherein the stops control the stroke volume by preventing the traveling stage from sliding beyond the second position toward the second plate.

Clause 7: The pump of Clause 6, further comprising a first spring disposed about the bellows intermediate the second plate and the traveling stage to bias the traveling stage to the first position.

Clause 8: The pump Clause 7, further comprising second springs disposed about the guide rods intermediate the first plate and the traveling stage to counteract a force applied to the traveling stage by the first spring.

Clause 9: A method for filling a container with a metal using a filling system, the filling system comprising a supply tank at least partially filled with the metal, a pump, a filling chamber, a first line for fluid communication between the supply tank and the pump, and a second line for fluid communication between the pump and the filling chamber, the method comprising: loading the container into the filling chamber; applying a vacuum to the filling chamber; heating the filling chamber to a liquid-phase temperature of the metal; heating the supply tank to the liquid-phase temperature of the metal to liquefy the metal; heating the pump, the first line, and the second line to the liquid-phase temperature of the metal; pressurizing the supply tank to cause the metal to flow from the supply tank and fill the pump, the first line, and the second line; and cycling the pump for a predetermined number of cycles to fill the container with the metal.

Clause 10: The method of Clause 9, wherein the pump comprises a bellows chamber, wherein the first line comprises an actuated intake valve, wherein the second line comprises an actuated discharge valve, and wherein cycling the pump for the predetermined number of cycles to fill the container with the metal comprises: closing the discharge valve; expanding the bellows chamber to cause a predetermined volume of metal to enter the bellows chamber; closing the intake valve; opening the discharge valve; contracting the bellows chamber to cause the predetermined volume of metal to exit the bellows chamber, thereby causing the predetermined volume of metal to enter the container.

Clause 11: The method of Clause 10, wherein the pump further comprises an actuator, a first plate supporting the actuator, a second plate, guide rods extending between the first plate and the second plate, a traveling stage operatively coupled to the actuator and slidable along the guide rods intermediate the first plate and the second plate, and a bellows extending between and hermetically sealed to the second plate and the traveling stage to define the bellows chamber; wherein expanding the bellows chamber comprises applying a first action by the actuator to slide the traveling stage toward the first plate to a first position; and wherein contracting the bellows chamber comprises applying a second action by the actuator to slide the traveling stage toward the second plate to a second position.

Clause 12: The method of Claim 11, wherein the container is a heat pipe.

Clause 13: The method of Claim 12, wherein the metal is an alkali metal.

Clause 14: The method of Claim 13, wherein heating the supply tank to the liquid-phase temperature of the metal to liquefy the metal comprises heating the supply tank to a temperature in a range of 100° C. to 200° C.

Clause 15: A system for filling a container with a metal, the system comprising: a supply tank at least partially fillable with the metal; a bellows pump configured to pump a predetermined volume of the metal from the supply tank to the container; a filling chamber to at least partially enclose the container; a first line for fluid communication between the supply tank and the bellows pump; a second line for fluid communication between the bellows pump and the filling chamber; and an oven to heat at least one of the supply tank, the bellows pump, the first line, the second line, or a combination thereof to a liquid-phase temperature of the metal.

Clause 16: The system of Clause 15, wherein the bellows pump comprises a bellows chamber, wherein the bellows chamber is actuatable between an expanded configuration and a contracted configuration to cause an intake stroke and a discharge stroke, and wherein the intake stroke and the discharge stoke act to pump the predetermined volume of the metal from the supply tank to the container.

Clause 17: The system of Clause 16, further comprising: a first actuated valve in the first line, wherein the first actuated valve is configured to be open during the intake stroke and to be closed during the discharge stroke; and a second actuated valve in the second line, wherein the second actuated valve is configured to be closed during the intake stroke and to be closed during the discharge stroke.

Clause 18: The system of Clause 17, wherein the bellows pump further comprises: an actuator comprising a drive rod; a first plate supporting the actuator; a second plate defining an intake port and a discharge port; guide rods extending between and coupled to the first plate and the second plate; a traveling stage slidable along the guide rods intermediate the first plate and the second plate, the traveling stage operatively coupled to the drive rod; a bellows extending between and hermetically sealed to the second plate and the traveling stage to define the bellows chamber; wherein the actuator is configured to slide the traveling stage along the guide rods to actuate the bellows chamber between the expanded configuration and the contracted configuration.

Clause 19: The system of any one of Clauses 15-18, further comprising: a vacuum header to apply a vacuum to at least one of the first line, the second line, the bellows pump, the filling chamber, or a combination thereof; and an inert gas header to apply a pressure to the supply tank and cause the metal to flow from the supply tank to fill the first line, the bellows pump, and at least a portion of the second line.

Clause 20: The system of any one of Clauses 15-19, wherein the container is a heat pipe and wherein the metal is an alkali metal.

Those skilled in the art will recognize that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

It is worthy to note that any reference to "one aspect," "an aspect," "an exemplification," "one exemplification," and the like means that a particular feature, structure, or characteristic described in connection with the aspect is included in at least one aspect. Thus, appearances of the phrases "in one aspect," "in an aspect," "in an exemplification," and "in one exemplification" in various places throughout the specification are not necessarily all referring to the same aspect. Furthermore, the particular features, structures or characteristics may be combined in any suitable manner in one or more aspects.

Any patent application, patent, non-patent publication, or other disclosure material referred to in this specification and/or listed in any Application Data Sheet is incorporated by reference herein, to the extent that the incorporated materials is not inconsistent herewith. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system that "comprises," "has," "includes" or "contains" one or more elements possesses those one or more elements, but is not limited to possessing only those one or more elements. Likewise, an element of a system, device, or apparatus that "comprises," "has," "includes" or "contains" one or more features possesses those one or more features, but is not limited to possessing only those one or more features.

The term "substantially", "about", or "approximately" as used in the present disclosure, unless otherwise specified, means an acceptable error for a particular value as determined by one of ordinary skill in the art, which depends in part on how the value is measured or determined. In certain embodiments, the term "substantially", "about", or "approximately" means within 1, 2, 3, or 4 standard deviations. In certain embodiments, the term "substantially", "about", or "approximately" means within 50%, 20%, 15%, 10%, 9%, 8%, 7%, 6%, 5%, 4%, 3%, 2%, 1%, 0.5%, or 0.05% of a given value or range.

In summary, numerous benefits have been described which result from employing the concepts described herein. The foregoing description of the one or more forms has been presented for purposes of illustration and description. It is not intended to be exhaustive or limiting to the precise form disclosed. Modifications or variations are possible in light of the above teachings. The one or more forms were chosen and described in order to illustrate principles and practical application to thereby enable one of ordinary skill in the art to utilize the various forms and with various modifications as are suited to the particular use contemplated. It is intended that the claims submitted herewith define the overall scope.

What is claimed is:

1. A pump capable of pumping liquid metal, the pump comprising:

an actuator comprising a drive rod;

a first plate supporting the actuator;

a second plate defining an intake port and a discharge port;

guide rods extending between and coupled to the first plate and the second plate;

a traveling stage slidable along the guide rods intermediate the first plate and the second plate, the traveling stage operatively coupled to the drive rod;

a bellows extending between and hermetically sealed to the second plate and the traveling stage to define a bellows chamber, wherein the actuator is configured to slide the traveling stage toward the first plate to a first position to expand the bellows chamber and cause a liquid to flow through the intake port and into the bellows chamber, and wherein the actuator is configured to slide the traveling stage toward the second plate to a second position to contract the bellows chamber and cause the liquid to flow out of the bellows chamber and through the discharge port;

a first spring disposed about the bellows intermediate the second plate and the traveling stage to bias the traveling stage to the first position;

second springs disposed about the guide rods intermediate the first plate and the traveling stage to counteract a force applied to the traveling stage by the first spring, and stops removably disposed about the guide rods intermediate the second plate and the traveling stage, wherein the bellows chamber has a first volume when the traveling stage is in the first position and a second volume when the traveling stage is in the second position, wherein a stroke volume of the pump is defined based on a difference between the first volume and the second volume, and wherein the stops control the stroke volume by preventing the traveling stage from sliding beyond the second position toward the second plate.

2. The pump of claim 1, wherein the second plate comprises a second plate material, wherein the traveling stage comprises a traveling stage material, wherein the bellows comprises a bellows material, wherein each of the second plate material, the traveling stage material, and the bellows material are chemically compatible with a liquid alkali metal, and wherein each of the second plate material, the traveling stage material, and the bellows material are selected to withstand a temperature and pressure of a liquid phase of the liquid alkali metal.

3. The pump of claim 2, wherein the liquid alkali metal comprises sodium, potassium, cesium, rubidium, lithium, or francium, or an alloy of any combination thereof.

4. The pump of claim 3, wherein the second plate material, the traveling stage material, and the bellows material each comprise austenitic stainless steel.

5. The pump of claim 4, wherein the bellows comprises:

a first flange welded to the traveling stage to hermetically seal the bellows to the traveling stage;

a second flange welded to the second plate to hermetically seal the bellows to the second plate; and convolutions intermediate the first flange and the second flange.

6. A method for filling a container with a metal using a filling system comprising the pump of claim 1, the filling system further comprising a supply tank at least partially filled with the metal, a filling chamber, a first line for fluid communication between the supply tank and the pump, and a second line for fluid communication between the pump and the filling chamber, the method comprising:

loading the container into the filling chamber;

applying a vacuum to the filling chamber;

heating the filling chamber to a liquid-phase temperature of the metal;

heating the supply tank to the liquid-phase temperature of the metal to liquefy the metal;

heating the pump, the first line, and the second line to the liquid-phase temperature of the metal;

pressurizing the supply tank to cause the metal to flow from the supply tank and fill the pump, the first line, and the second line; and cycling the pump for a predetermined number of cycles to fill the container with the metal.

7. The method of claim 6, wherein the first line comprises an actuated intake valve, wherein the second line comprises an actuated discharge valve, and wherein cycling the pump for the predetermined number of cycles to fill the container with the metal comprises:

closing the discharge valve;

expanding the bellows chamber to cause a predetermined volume of metal to enter the bellows chamber;

closing the intake valve;

opening the discharge valve;

contracting the bellows chamber to cause the predetermined volume of metal to exit the bellows chamber, thereby causing the predetermined volume of metal to enter the container.

8. The method of claim 6, wherein the container is a heat pipe.

9. The method of claim 8, wherein the metal is an alkali metal.

10. The method of claim 9, wherein heating the supply tank to the liquid-phase temperature of the metal to liquefy the metal comprises heating the supply tank to a temperature in a range of 100° C. to 200° C.

11. A system configured to fill a container with a metal using the pump of claim 1, the system comprising:

a supply tank at least partially fillable with the metal;

the pump, wherein the pump is configured to pump a predetermined fill volume of the metal from the supply tank to the container;

a filling chamber to at least partially enclose the container;

a first line for fluid communication between the supply tank and the pump;

a second line for fluid communication between the pump and the filling chamber; and an oven to heat at least one of the supply tank, the pump, the first line, the second line, or a combination thereof to a liquid-phase temperature of the metal.

12. The system of claim 11, further comprising:

a vacuum header to apply a vacuum to at least one of the first line, the second line, the pump, the filling chamber, or a combination thereof; and an inert gas header to apply a pressure to the supply tank and cause the metal to flow from the supply tank to fill the first line, the pump, and at least a portion of the second line.

13. The system of claim 11, wherein the container is a heat pipe and wherein the metal is an alkali metal.

14. They system of claim 11, wherein cycling the pump a predetermined number of cycles at the stroke volume causes the pump to pump the predetermined fill volume of metal from the supply tank to the container.

* * * * *